US005804714A

United States Patent [19]

Rouhiainen

[11] Patent Number: 5,804,714

[45] Date of Patent: Sep. 8, 1998

[54] FLOW METER

[75] Inventor: Pekka Rouhiainen, Helsinki, Finland

[73] Assignee: Posiva Oy, Helsinki, Finland

[21] Appl. No.: 913,011

[22] PCT Filed: Jan. 12, 1996

[86] PCT No.: PCT/FI96/00028

§ 371 Date: Sep. 4, 1997

§ 102(e) Date: Sep. 4, 1997

[87] PCT Pub. No.: WO97/25517

PCT Pub. Date: Jul. 17, 1997

[51] Int. Cl.[6] ..... E21B 49/00

[52] U.S. Cl. ..... 73/152.29

[58] Field of Search ..... 73/152.29, 152.36, 73/152.31–152.35, 185, 188, 202, 195

[56] References Cited

U.S. PATENT DOCUMENTS

| | | | |
|---|---|---|---|
| 4,800,752 | 1/1989 | Piers | 73/155 |
| 4,928,758 | 5/1990 | Siegfried, II | 166/66 |
| 5,178,006 | 1/1993 | Wicks, III et al. | 73/155 |
| 5,184,677 | 2/1993 | Dobscha et al. . | |
| 5,226,485 | 7/1993 | Dobscha et al. . | |
| 5,337,821 | 8/1994 | Peterson . | |

FOREIGN PATENT DOCUMENTS

| | | |
|---|---|---|
| 1291856 | 3/1962 | France . |

*Primary Examiner*—Richard Chilcot
*Assistant Examiner*—Jewel V. Aryis
*Attorney, Agent, or Firm*—Andrus, Sceales, Starke & Sawall

[57] ABSTRACT

Flowmeter for locating zones containing currents in a bore hole made in a rock. The flowmeter comprises parting elements (1) for separating a measurement section (3) in the hole from the rest of the hole in a substantially pressure-tight manner; an open flow duct (4) forming a free flow link between the hole portions on opposite sides of the flowmeter past the measurement section; and a measuring duct (5) leading from the section under measurement to a point outside it, together with measuring equipment (6), for measuring the magnitude and direction of flow between the measurement section and the hole portion outside it.

10 Claims, 1 Drawing Sheet

FLOW METER

BACKGROUND OF THE INVENTION

The present invention relates to a flowmeter designed to find areas containing currents in a hole bored in rock.

In searching rocks via measurements in deep bore holes, a serious problem is the slowness of the measurements. Measuring only the vertical current at a given depth in a hole provides practically no information about chinks at different depths in the rock or the magnitude and direction of currents flowing in them. On the other hand, making accurate measurements e.g. by sections of a few hundred meters over the whole length of the hole to obtain the flow rates and directions for the section is a very slow process in long holes going to depths as large as thousands of meters.

As the bore hole may contain long stretches of solid rock without any fissures or currents, the object of the invention is to produce a new type of flowmeter which makes it possible to search even deep holes and locate the areas containing currents for more elaborate further investigation.

As for the features characteristic of the invention, reference is made to the claims.

SUMMARY OF THE INVENTION

The flowmeter of the invention comprises suitable flexible and elastic parting elements by means of which the section to be measured is separated from the hole substantially pressure-tightly. In other words, the parting elements are made of an elastic material that is pressed against the surfaces of the hole under measurement, such that they are tightly pressed against the hole without any inflatable or expandable structures activated by means of a pressure medium. Moreover, the flowmeter is provided with an open flow duct forming a free flow connection past the section under measurement delimited by the parting elements, so that currents occurring in other parts of the hole will not produce any pressure differences against the parting elements and these will, with a relatively low pressure, sufficiently seal off the hole section to be searched. In addition, the flowmeter comprises a measuring duct leading from the section under measurement to a point outside it and provided with measuring instruments by means of which the total flow of currents flowing into or out of the section can be measured.

The flexible and elastic parting elements used are preferably plate-shaped or ring-shaped rubber or plastic discs with a free external diameter somewhat larger than the diameter of the hole to be searched. Moreover, in a hole measured from a direct radial direction, the rubber or plastic discs preferably have a shape turned or curved somewhat upwards, permitting easy descent of the flowmeter down the hole by the agency of its own weight. At the measuring depth, the flowmeter is pulled back up through a small distance, causing the discs to buckle into a different position. In this condition, the internal tension of the parting element itself presses it against the hole surface, increasing its tightness.

The rubber discs of the invention acting as parting elements cannot withstand a very large pressure. On the other hand, in this type of measurement the pressure level in the section under measurement is the same as in the rest of the hole, so there is no need for a high pressure-tightness. However, to ensure tightness, both parting elements are made up of several, e.g. three successive rubber discs. The prototype of the flowmeter of the invention was implemented using three rubber discs, which can withstand the pressure of a 1½-meter water column and therefore provide a sufficient tightness in all relevant measurement circumstances.

Especially when relatively large and sloping holes are being searched, the flowmeter's own weight may press the rubber discs to one side, causing the sealing to leak on the other side. In such applications it is preferable to use separate disc-shaped, plug-shaped or other similar rigid centering elements which, having a diameter nearly equal to that of the hole, prevent significant radial motion of the flowmeter in the hole.

The measuring equipment preferably includes a suitable impulse source and sensors for measuring the direction and velocity of the impulse transmitted by the impulse source.

The length of the bore hole section measured by the flowmeter of the invention is preferably freely adjustable. This can be achieved e.g. by using suitable extension pieces, of which a desired number can be mounted between the parting elements. In this way, the length of the hole section measured at a time may vary e.g. from one meter to over ten meters. Therefore, the hole can be first searched in very long sections, whereupon the sections containing currents can be checked in shorter sections. Hole portions that require slower and more precise flow measurements using more accurate equipment can thus be located with an accuracy of e.g. one meter.

It is also possible to implement the flowmeter using a telescopic structure in the meter body between the parting elements to allow adjustment of its length.

The flowmeter of the invention has significant advantages over prior-art technology. The flowmeter allows very fast measurement of holes several kilometers in length, making it possible to locate hole portions containing currents, which are then examined more closely using other equipment. Thus, as compared to prior art, the time required for measuring and examining a single hole is reduced from months to a few days.

DETAILED DESCRIPTION OF THE INVENTION

Figure 1:
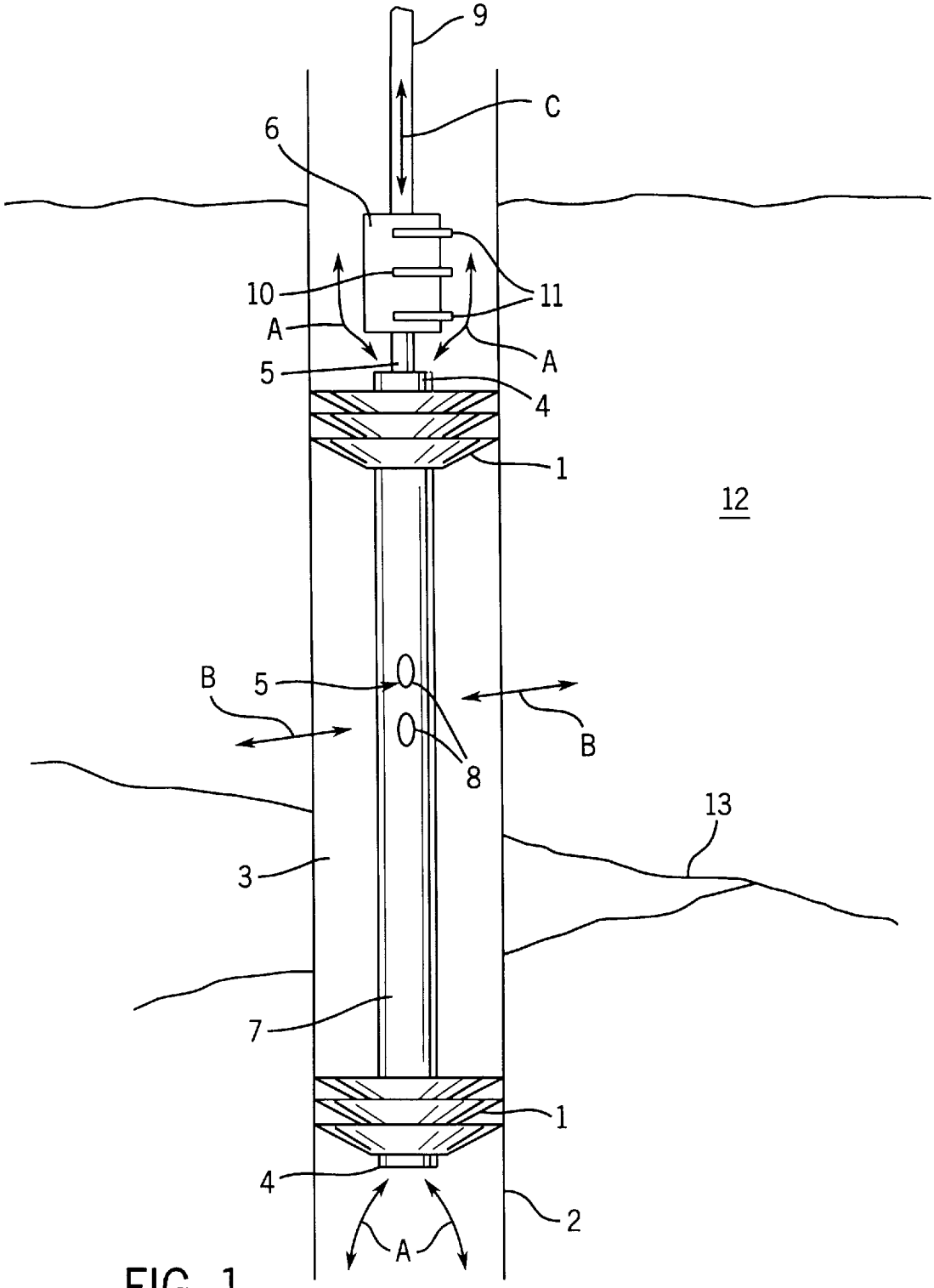

In the following, the invention is described by referring to the attached drawing, which presents a diagram representing a flowmeter as provided by the invention.

The flowmeter of the invention as presented in the drawing comprises an open pipe 7 with three ring-shaped, elastic parting elements 1 at each end, forming between them a measurement section 3 in the hole 2. The pipe 7 forms an open flow duct 4 past the measurement section 3 delimited by the parting elements 1 in the hole.

The parting elements 1 are elastic and flexible rubber flanges which, slightly deviating from the direction of the radius of the hole, extend obliquely upwards. Their size is so chosen that their elasticity will cause them to press against the round surface of the hole, in other words, their free external diameter is somewhat larger than that of the hole.

The pipe 7 between the parting elements 1 is provided with two apertures 8 which, however, do not communicate with the open flow channel 4, but form the starting point of a measuring duct 5 which runs inside the pipe 7 to measuring equipment 6 and, through this equipment, opens into the hole portion above the flowmeter.

The measuring equipment 6 comprises an impulse source 10 placed in the measuring channel, and, placed on either side of it, sensors 11 allowing the impulse sent by the impulse source, i.e. the velocity and direction of motion of the impulse, to be measured.

Moreover, the flowmeter is provided with a hoisting and control cable 9 by means of which the flowmeter can be raised and lowered in the hole under measurement e.g. using a suitable winch and through which the measurement information obtained from the measuring equipment 6 is transferred to suitable processing apparatus provided above ground.

The flowmeter is used as follows. The flowmeter, suspended by the hoisting and control cable 9, is lowered into the hole to be measured to a desired measuring depth. At this depth, the flowmeter is pulled up through a short distance (a few centimeters), causing the plate-shaped parting elements to be pressed tightly against the hole surface. In this way, a section 3 to be measured has been separated from the hole with sufficient sealing. To ensure that the parting elements will not be affected by currents and pressure differences outside the measurement section 3, pipe 7 provides a free flow path (arrows A) for external currents past the measurement section 3.

If the rock 12 within the area covered by the measurement section 3 contains any fissures 13 with currents (arrow B) in them, these currents can cause a flow through the apertures 8 into the measuring duct 5 and through it (arrow C) further outside the flowmeter.

The flow rates in the measuring duct 5 may show large variations, which is why flow measurement is performed by two methods. First, flow measurement is started by an impulse method, in which the water is heated momentarily by means of a heating thermistor 10 and the movement of the heat impulse produced by it in the water is monitored by means of sensors 11 placed on either side of the heating thermistor at a distance from it. As the cross-sectional area of the measuring duct 5 is known, both the magnitude and direction of the flow are obtained by this method. This method can be used to measure currents with flow rates varying from a few milliliters to three thousand milliliters per hour.

Above the upper limit stated above, the divergence of the measurement results increases, and the flow is determined by using a cooling method. In the cooling method, the heating thermistor 10 is heated, whereupon its cooling down is monitored, because the cooling takes place the faster the higher is the flow rate. By using the cooling method, it has been possible to extend the measuring range to 60000 ml/h and beyond.

After the measurements on a given section have been finished, the flowmeter can be easily moved, raised or lowered to the next place, and measurements can thus be continued one section at a time over the whole length of the bore hole.

In addition, the apparatus preferably comprises a pump for keeping the water level in the hole under measurement at a constant height. This can be implemented using a long surge pipe whose lower end is blocked while the upper end is open. With this solution, the pumping of the water is effected from inside the surge pipe as the water in the hole flows into the surge pipe placed on a constant height. The water level inside the pipe varies but remains at constant height in the hole, i.e. at the level of the upper end of the pipe.

The apparatus may further comprise a pump for pumping water into the hole while the hoisting and control cable is being pulled up. This prevents the water level from falling as a result of the cable being raised. In this way, the pumps can be used to keep the pressure conditions as constant as possible throughout the measuring operation.

The particulars of the use of the flowmeter and the processing of the data are in themselves known in the art, so they will not be explained in detail in this context. They can be summarized at a general level by saying that the measuring programs proper are contained in a measuring computer which sends control commands to a processor in the flowmeter and receives measurement results from the processor. The measurement results are subjected to conversions as required and they are presented on a display screen and saved in files. Moreover, the measuring computer reads the pressure data (air pressure and ground water level), controls the hose pump, reads the pulses of a cable counter and stops the winch on the basis of the cable counter pulses. The measuring programs of the processor are stored in the flowmeter's program storage. These programs are used to take care of measurement timing, selection of measuring channels, control of analog/digital conversion and sending the measurement results to above-ground equipment.

The invention has been described above in detail by the aid of the attached drawing, but different embodiments of the invention are possible within the scope of the inventive idea defined by the claims.

I claim:

1. Flowmeter for locating zones containing currents in a bore hole made in a rock, wherein the flowmeter comprises flexible and elastic parting elements (1) for separating a measurement section (3) in the hole from the rest of the hole in a substantially pressure-tight manner, an open flow duct (4) forming a free flow link between the hole portions on opposite sides of the flowmeter past the measurement section, a measuring duct (5) leading from the section under measurement to a point outside it, together with measuring equipment (6), for measuring the magnitude and direction of flow between the measurement section and the hole portion outside it, and wherein the parting elements (1) comprise plate-shaped rubber or plastic discs.

2. Flowmeter as defined in claim 1, characterized in that, in the vertical hole under measurement, the edges of the rubber or plastic discs are bent upwards.

3. Flowmeter as defined in claim 1, characterized in that a parting element comprises at least two, preferably three rubber discs (1) placed on top of each other.

4. Flowmeter as defined in claim 1, characterized in that the measuring equipment (6) comprises an impulse source (10) and sensors (11) for measuring the direction and velocity of an impulse sent by the impulse source.

5. Flowmeter as defined in claim 1, characterized in that a body of the flowmeter between the parting elements (1) comprises of a hollow pipe (7) which acts as a flow duct (4).

6. Flowmeter as defined in claim 5, characterized in that the pipe (7) is provided with an aperture (8) between the parting elements (1), from which aperture the measuring duct starts, extending inside the pipe to measuring equipment (6) on the other side of the parting element.

7. Flowmeter as defined in claim 1, characterized in that the flowmeter is provided with adjusting elements for the adjustment of the distance between the parting elements (1), i.e. the length of the hole portion to be measured.

8. Flowmeter as defined in any one of claim 1, characterized in that the flowmeter is connected via a hoisting and control cable (9) to a hoisting device and a measurement data processing apparatus outside the hole.

9. Flowmeter as defined in claim 1, characterized in that in conjunction with the flowmeter there is equipment for keeping the water level at a constant height in the hole during different stages of measurements and during transfer of the flowmeter in the hole.

10. Flowmeter as defined in claim 2, characterized in that a parting element comprises at least two, preferably three rubber discs (1) placed on top of each other.

* * * * *